US005324007A

United States Patent [19]

Freneix

[11] Patent Number: 5,324,007

[45] Date of Patent: Jun. 28, 1994

[54] LOAD-HOISTING SYSTEM HAVING TWO SYNCHRONOUSLY ROTATING DRUMS OPERATING IN PARALLEL

[75] Inventor: Gérard Freneix, St. Sebastien, France

[73] Assignee: ACB, Paris, France

[21] Appl. No.: 74,149

[22] Filed: Jun. 9, 1993

Related U.S. Application Data

[63] Continuation of Ser. No. 670,836, Mar. 18, 1991, abandoned.

[30] Foreign Application Priority Data

Mar. 21, 1990 [FR] France ..... 90 03625

[51] Int. Cl.[5] ..... B66D 1/54

[52] U.S. Cl. ..... 254/300; 254/285; 254/321

[58] Field of Search ..... 254/285, 284, 286, 299, 254/300, 310, 317, 321, 387, 346, 365, 352; 464/160, 45, 46

[56] References Cited

U.S. PATENT DOCUMENTS

| | | | |
|---|---|---|---|
| 1,609,421 | 12/1926 | Norris | 254/300 X |
| 2,984,455 | 5/1961 | Fischer | 254/286 X |
| 4,214,664 | 7/1980 | Polen | 254/285 X |
| 4,236,694 | 12/1980 | Kristensson | 254/365 |
| 4,489,919 | 12/1984 | Ostrobrod | 254/346 |
| 4,851,980 | 7/1987 | McWilliams | 254/285 X |

FOREIGN PATENT DOCUMENTS

| | | | |
|---|---|---|---|
| 1026505 | 3/1958 | Fed. Rep. of Germany . | |
| 1202454 | 10/1965 | Fed. Rep. of Germany . | |
| 1276311 | 8/1968 | Fed. Rep. of Germany . | |
| 2019909 | 10/1971 | Fed. Rep. of Germany . | |
| 2853038 | 6/1979 | Fed. Rep. of Germany . | |
| 1495528 | 8/1967 | France . | |
| 2081769 | 12/1971 | France . | |
| 2380979 | 10/1978 | France | 254/285 |
| 655450 | 7/1951 | United Kingdom . | |
| 978133 | 12/1964 | United Kingdom . | |
| 1505244 | 3/1978 | United Kingdom . | |
| 2179618 | 3/1987 | United Kingdom . | |

*Primary Examiner*—Katherine Matecki
*Attorney, Agent, or Firm*—Sughrue, Mion, Zinn, Macpeak & Seas

[57] ABSTRACT

A load-hoisting system comprising a motor and gear box unit having the parallel outlet gears. Each outlet gear drives a hoisting device connected to the load by a cable, such a device comprising a toothed disk meshing with one of the two outlet gears, the toothed disk driving a winch drum via a friction clutch comprising an intermediate clutch disk, the cable being attached to and wound on the drum, the intermediate disk including retaining catches preventing it from rotating in a direction corresponding to lowering the load, the drum being fixed to a central shaft whose rotation in the direction corresponding to lowering the load ensures that the clutch is engaged. The central shaft is synchronized in rotation with the central shaft of the other hoisting device by means of a plate coupling and a coupling disk provided with tenons or grooves that are orthogonal, the two central shafts being supported by a fixed frame.

4 Claims, 4 Drawing Sheets

LOAD-HOISTING SYSTEM HAVING TWO SYNCHRONOUSLY ROTATING DRUMS OPERATING IN PARALLEL

This is a continuation of application Ser. No. 07/670,836 filed Mar. 18, 1991 now abandoned.

BACKGROUND OF THE INVENTION

The present invention relates to a load-hoisting system providing anti-fall safety by redundancy in the hoisting members situated between the load and the hoisting motor and gear box unit.

SUMMARY OF THE INVENTION

The invention thus provides a load-hoisting system comprising a motor and gear box unit having two parallel outlet gears, wherein each outlet gear drives a hoisting device connected to the load by a cable, such a device comprising a toothed disk meshing with one of the two outlet gears, said toothed disk driving a winch drum via a friction clutch including an intermediate clutch disk, said cable being attached to and wound on said drum, said intermediate disk including retaining catches preventing it from rotating in a direction corresponding to lowering the load, the drum being fixed to a central shaft whose rotation in the direction corresponding to lowering the load ensures that the clutch is engaged, and wherein said central shaft is synchronized in rotation with the central shaft of the other hoisting device by means of a plate coupling and a coupling disk provided with tenons or grooves that are orthogonal, the two central shafts being supported by a fixed frame.

In a particular embodiment, said intermediate clutch disk is sandwiched between a hub providing a connection between said drum and said central shaft and including a thrust surface against which said disk bears, and a nut-plate mounted on a threaded bearing surface of said central shaft, said nut-plate being rotated by a centralizer which is fixed to said toothed disk, said rotary connection of the centralized and of said nut plate taking place via means enabling said nut-plate to move slightly axially relative to said centralizer, rotation of said toothed disk in the direction corresponding to raising said load causing said nut-plate to move axially in the direction that presses it against said intermediate clutch disk.

The cable of each hoisting device is attached to the load and then passes over a return sheave prior to being wound onto the winch drum, the two return sheaves being mounted at the two ends of a spreader bar horizontally hinged in its middle to a fixed portion which is fixed to said frame vertically above said load, movement of said spreader bar being limited between two abutments each provided with a detector.

Said load may be mounted to slide along a vertical column.

BRIEF DESCRIPTION OF THE DRAWINGS

An embodiment of the invention is described by way of example with reference to the accompanying drawings, in which.

DETAILED DESCRIPTION

Figure 1:
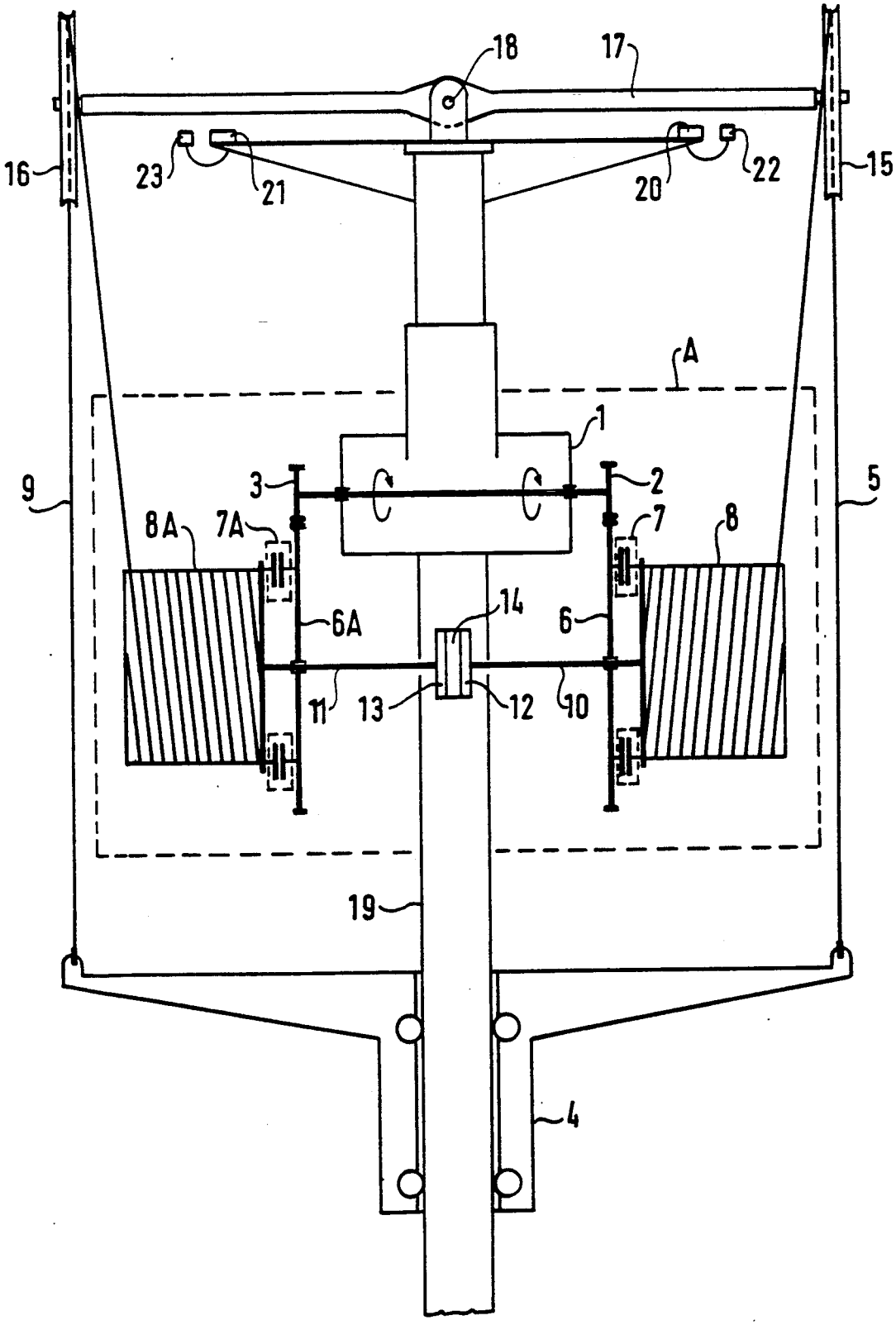
FIG. 1 is a diagrammatic general view of a load-hoisting system of the invention.

With reference now to FIG. 1 which shows the principle of a load-hoisting system of the invention, there can be seen a motor and gear box unit 1 having an outlet gear at each of its ends: a gear 2 to the right and a gear 3 to the left. These gears are disposed in parallel and are strictly constrained to rotate together. The gear 2 drives a first hoisting device which is connected to a load 4 by a first cable 5.

This first hoisting device, to the right in the figure, comprises a toothed disk 6 which drives a first winch drum 8 via a unidirectional friction clutch 7, the first cable 5 being paid out from and being wound onto the drum, to which it is fixed.

The left gear 3 likewise drives a second hoisting device which is connected to the load 4 via a second cable 9. This second hoisting device, situated to the left in the figure, is identical to the first and comprises a toothed disk 6A, a unidirectional friction clutch 7A, and a winch drum 8A.

Figure 3:
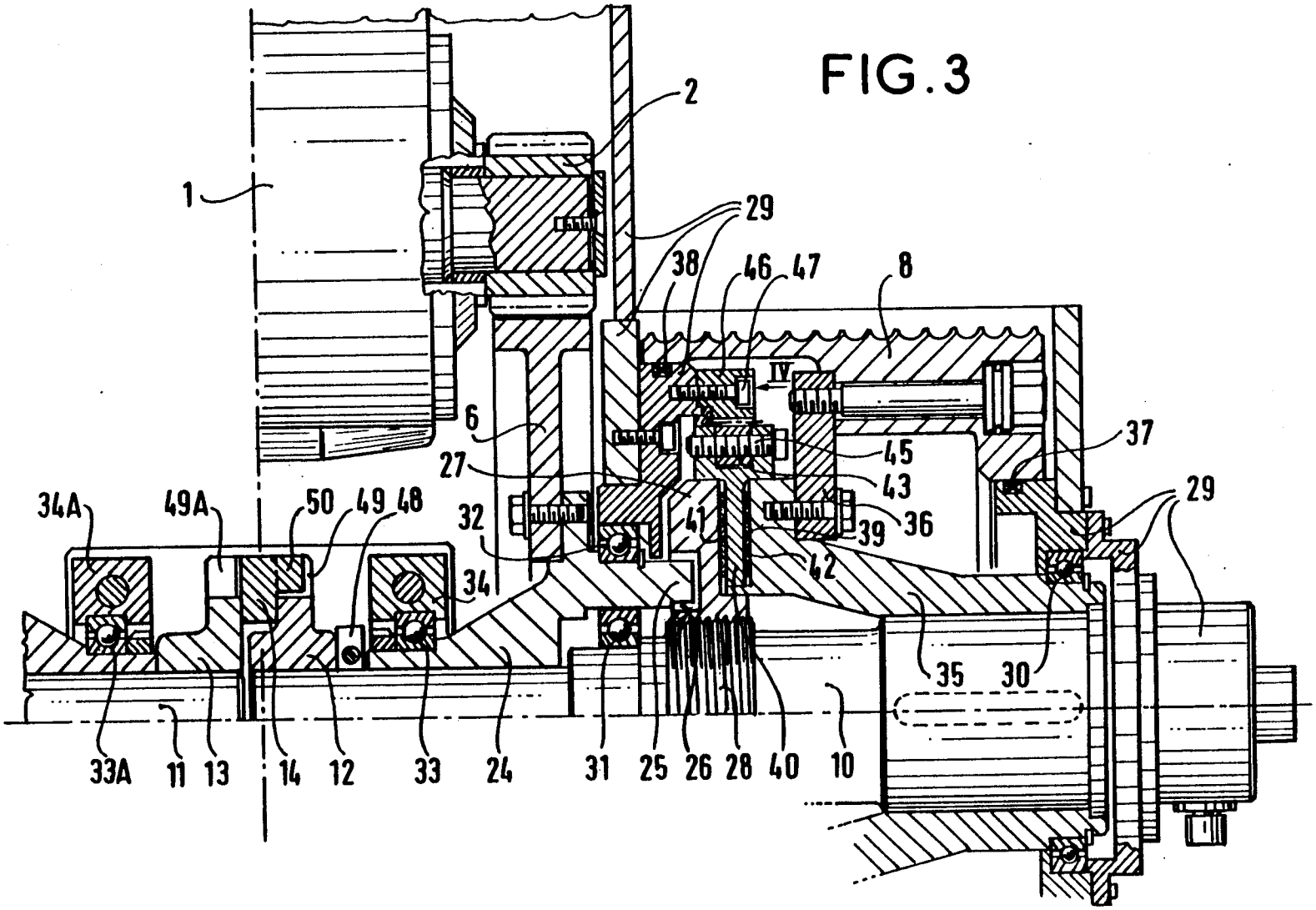
FIG. 3 is a fragmentary view on a larger scale than FIG. 2 and in axial section showing half of the motor and gear box unit, half of the righthand hoisting device, and the device for synchronizing the rotation of the two central shafts.
Figure 4:
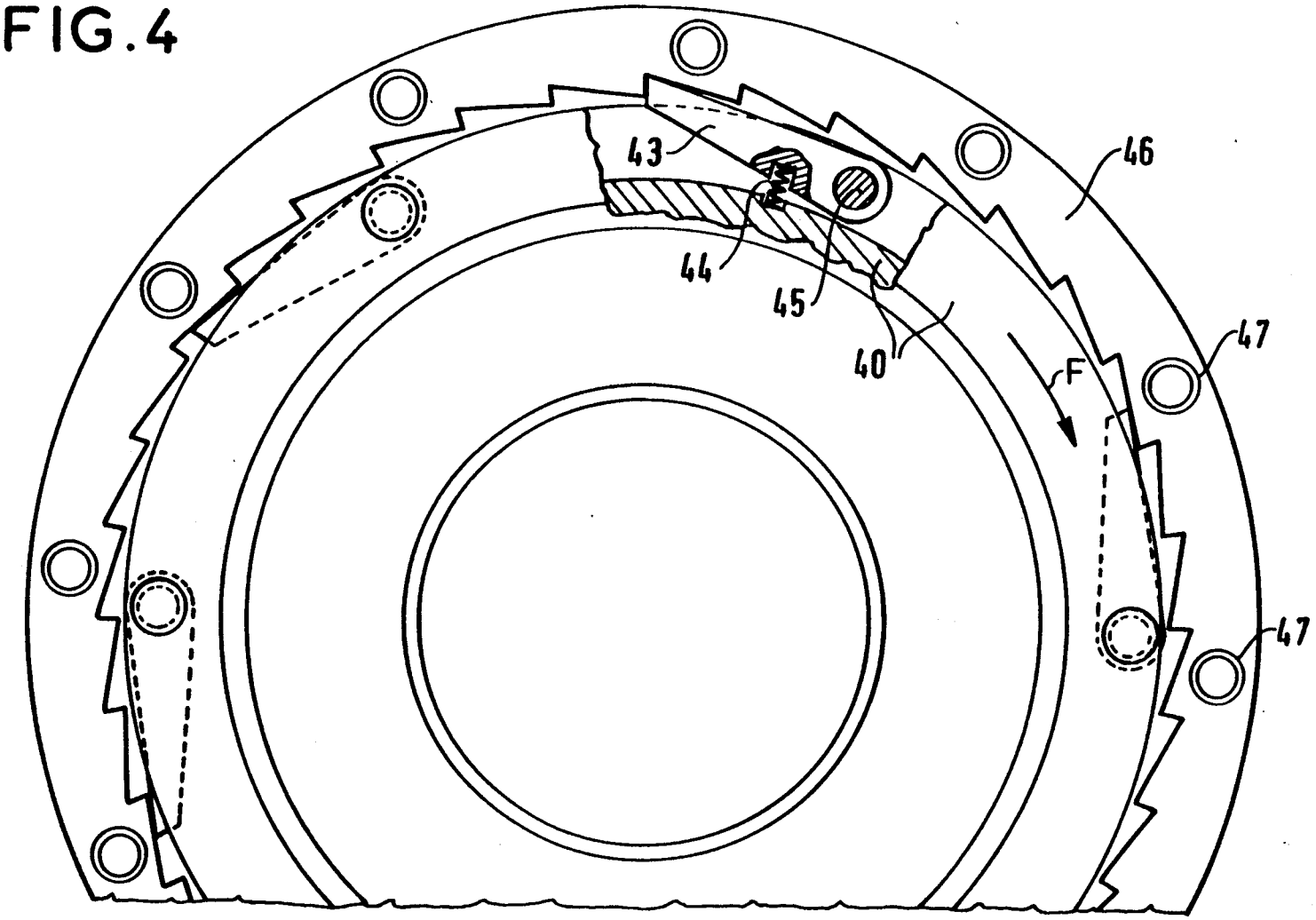
FIG. 4 is a fragmentary view as seen on arrow IV of FIG. 3 showing the catch retaining devices of the intermediate clutch disk.

As described in detail below with reference to FIGS. 3 and 4, the friction clutch 7 (or 7A) comprises an intermediate unidirectional clutch disk including retaining catches which prevent it from rotating in the direction corresponding to the load 4 moving downwards.

The hoisting system is thus redundant and ensures that the load 4 is supported in spite of a failure of any one of the various members in either of the two hoisting devices, including the outlet gear of the motor and gear box unit, and including the cables, providing that the failure or failures occur on one only of the right and left hoisting devices.

As described below, clutching is performed automatically on each side by rotating the outlet gear wheel in the direction for raising the load 4. In addition, rotating the drum 8 in the direction corresponding to lowering the load 4 also has the effect of automatically engaging the friction clutch 7 whose intermediate disk is retained by its catches specifically in the direction of rotation which corresponds to the load being lowered.

Thus, the load is lowered by an alternating succession of friction clutch engagements and disengagements by controlling the motor and gear box unit to rotate in the opposite direction to the raising direction: with disengagement being caused by said rotation and with engagement being caused by the drum rotating under the weight of the load.

Inevitably, such a system where lowering takes place by successive friction steps cannot be identical on both sides because the coefficients of friction are not absolutely identical on both sides, because wear is not absolutely equal, etc. . . . Also, to ensure that beth cables 5 and 9 are permanently under tension, it is necessary to ensure that the two drums 8 and 8A rotate synchronously.

To do this, each drum is fixed to a central shaft: 10 for the righthand device and 11 for the lefthand device, and these shafts are synchronized in rotation by a coupling having plates 12 and 13 and a coupling disk 14 having orthogonal tenons or grooves. Such a coupling is known per se and is called an "Oldham coupling".

This synchronization device is particularly advantageous since it avoids having a single long shaft, it enables the two shafts to be decoupled for tuning purposes and in particular for compensating for slack resulting from inevitable permanent and non-identical elongation of the two cables. To this end, the "Oldham coupling" comprises a plurality of orthogonal grooves and tenons so as to enable one of the two shafts to rotate through ⅛th of a turn or ¼th of a turn, for example. Finally, the coupling enables the two shafts to be out of alignment, making it possible for there to be a certain distance d between their axes.

The general hoisting system of the invention is thus redundant, synchronized, and fully mechanical, leading to no special requirements with respect to its electrical portion.

In FIG. 1, it can be seen that the cables 5 and 9 attached to the load 4 pass over return sheaves 15 and 16 prior to being wound onto the drums 8 and 8A.

These sheaves 15 and 16 are mounted at the ends of a spreader bar 17 which is hinged in its middle 18 to a fixed portion which is fixed to the frame of the assembly (described below). The horizontal hinge 18 is vertically above the load 4 which, in this case, is mounted to slide along a vertical column 19. The load 4 may be constituted, in fact, by a support for a member, a tool, or some other kind of load. The motion of the spreader bar 17 is limited between two abutments 20 and 21 each provided with a detector 22 and 23. This system makes it possible to detect differential elongation of the two cables 5 and 9, and thus to perform the adjustment described above.

Figure 2:
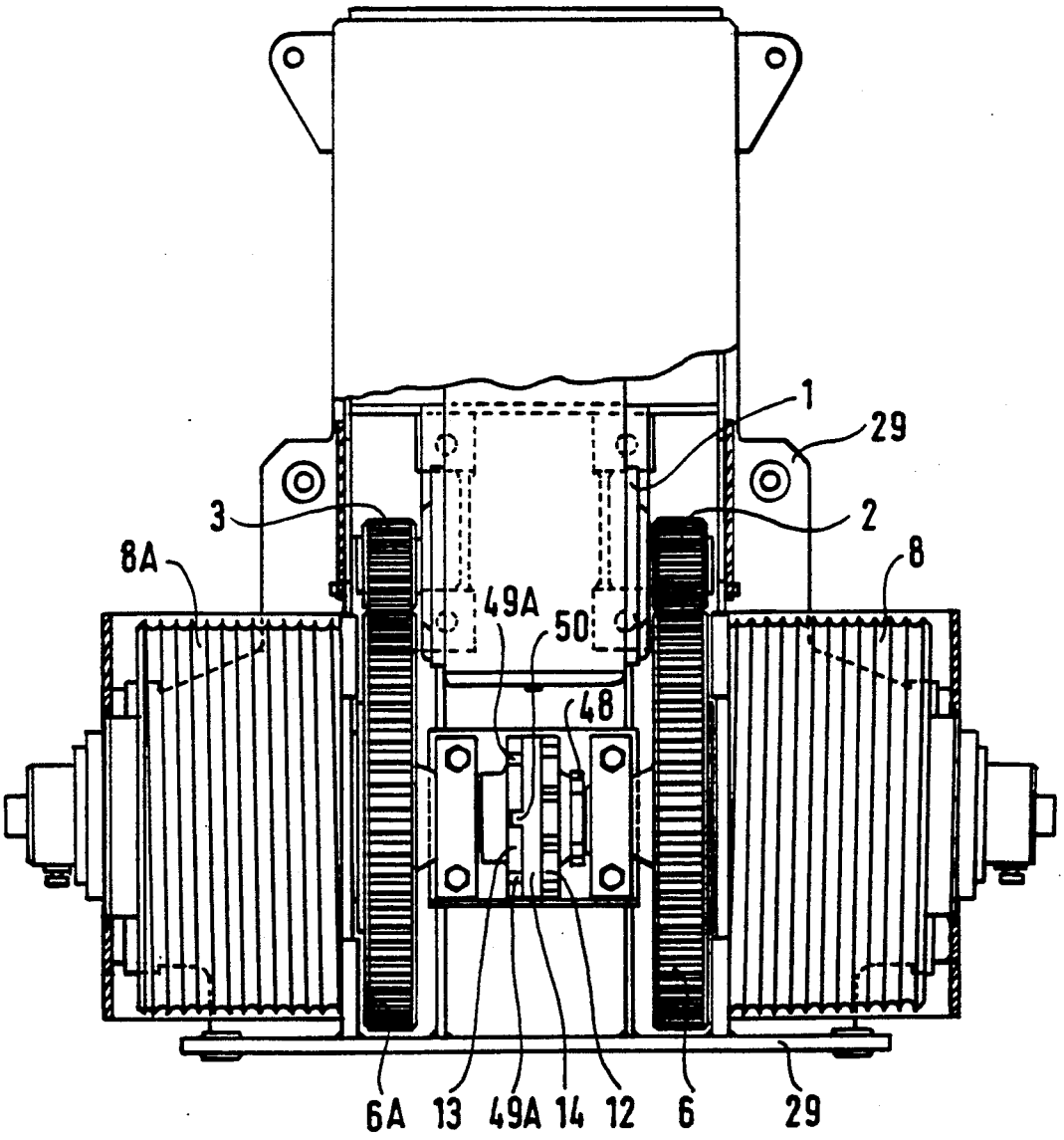
FIG. 2 shows a practical embodiment of assembly A in FIG. 1 showing the motor and gear box unit, the two hoisting devices, and the device for synchronizing the rotation of the two central shafts.

FIG. 2 shows a practical embodiment of the portion contained in box A of FIG. 1, comprising the motor and gear box unit 1 and the two hoisting devices together with their synchronization.

The righthand hoisting device and the synchronization device are now described in greater detail with reference to FIGS. 3 and 4, it being understood that the lefthand hoisting device is absolutely identical.

Outlet gear wheel 2 meshes with the toothed disk 6 which is fixed to a centralizer 24 including a plurality of drive fingers 25 that penetrate into recesses 26 in a nut-plate 27 mounted on a threaded bearing surface 28 of the central shaft 10. The recesses 26 are deep enough to enable the nut-plate 27 to move a little axially relative to the centralizer 24 by screwing and unscrewing the nut-plate 27 on the bearing surface 28. The central shaft 10 and the centralizer 24 are supported to rotate by a fixed frame 29 comprising a plurality of portions, with support taking place via ball bearings 30, 31, 32, and 33. Bearing 33 is mounted inside a fixed bearing surface 34 of the frame 29. The central shaft 10 is fixed to a hub 35 which is fixed to the drum 8 via a plate 36. The drum 8 rotates about portions of the fixed frame 29 with friction against gaskets 37 and 38 that seal off the inside of the mechanism. The hub 35 includes a plane surface 39 in the form of a circular ring which co-operates with the nut-plate 27 to sandwich an intermediate clutch disk 40 provided with rings 41 and 42 of material that provide good friction.

The intermediate clutch disk possesses catches 43 having springs 44. Each catch pivots about an axis 45. A fixed ratchet ring 46 is disposed around the disk 40 carrying the catches 43 and is connected to the frame 26 by screws 47.

The intermediate clutch disk can thus only rotate in the direction of arrow F (FIG. 4) which corresponds to the motor and gear box unit 1 rotating in the direction to raise the load 4.

At its end, the central shaft carries the plate 12 which is in abutment to the right against a two-part collar 48. The plate 12 has grooves 49 comprising at least two grooves at 90° to each other, and in practice comprising a plurality of pairs of grooves at 90°, with each pair of grooves being offset from the following pair by a certain angle, e.g. 15° or 30°, so as to enable the lengths of the cables 5 and 9 to be adjusted. To do this, it suffices merely to dismantle the collar 48, to move back the plate 12 which is keyed on the shaft 10, and to rotate the assembly to place the perpendicular pair of tenons 50 on the coupling disk 14 in an adjacent pair of grooves 49 of the plate 12, and then replace the collar 48 (it should be observed that the tenons could be carried on th plates 12 and 13, with the grooves then being in the disk 14).

Operation is as follows:

To raise the load, the motor and gear box unit is caused to rotate in the direction which causes the nut-plate 27 to be screwed towards the right. When, given the weight of the load 4, the disk 40 between the nut-plate 27 and the hub 35 is clamped sufficiently firmly, then rotation of the nut-plate 27 also drives the hub 35 in rotation thus rotating the drum 8 and the central shaft 10 which are connected to the hub. Rotation of the drum in the opposite direction is absolutely impossible while in this engaged position because of the disk 40 of catches.

To lower the load, the clutch must be disengaged. To do this, the motor and gear box unit 1 is rotated in the opposite direction, thereby displacing the nut-plate 27 to the left, thus releasing the hub 35 and thus the drum 8 which rotates under the weight of the load in the downwards direction (rotating relative to the intermediate disk 40 which is retained by its catches 43). However this rotation of the hub 35 also causes the central shaft 10 to rotate, thereby immediately causing the nut-plate 27 to be reclamped against the disk 40 and the hub 35 thus stopping further lowering of the load, unless the motor and gear box continues to rotate. Lowering thus takes place by an alternating succession of engagements and disengagements, with the speed of lowering being accurately controlled in practice by the speed of rotation of the motor and gear box unit 1 and without jolting by virtue of a small amount of sliding between the hub 35 and the intermediate clutch disk 40.

By virtue of the constant velocity coupling between the two central shafts 10 and 11, rotation is accurately synchronized and the only adjustment that is necessary comes from the fact that necessarily non-identical elongations occur between the two cables 5 and 9 after they have been operating for a certain length of time.

I claim:

1. A load-hoisting system for raising and lowering a load, said system comprising:

a fixed frame, a motor and gear box unit mounted to said fixed frame and including two parallel outlet gears, a pair of hoisting devices, each connected to said load by a cable, said pair of hoisting devices each comprising:

a winch drum selectively coupled respectively to a toothed disk driven by a respective outlet gear via a respective unidirectional friction clutch for raising said load, said cable being wound respectively about said winch drum and coupled to said load, said friction clutch including a fixed ratchet member, and an unidirectional intermediate disk including spring biased catches engagable with said fixed ratchet member for preventing said unidirectional intermediate disk from rotating in a direction corresponding to that of lowering the load, a central shaft for each winch drum supported by said fixed frame for rotation about an axis, said central shaft being fixedly connected to a respective drum, said friction clutch being operatively positioned between said toothed disk and said shaft, and said device further comprising means responsive to shaft rotation in a direction of lowering said load for effecting friction clutch engagement of said shaft by said outlet gear in a direction raising said load, means for synchronizing rotation of said central shafts comprising coupling plates and a coupling disk provided respectively with one of orthogonal, interengageable tenons and grooves such that shaft rotation of the drums in the direction of lowering of said load automatically effects clutch engagement between the shaft and the drums via said intermediate unidirectional disks, however, the intermediate disks via said catches and said fixed ratchet member are prevented from rotating in the direction corresponding to lowering of said load, thereby eliminating the possibility that the load will drive the motor in the direction of load lowering, and wherein any disruption of electrical feed to the motor prevents the load underfany condition from driving the motor, thereby eliminating the need for brakes within said system.

2. A load-hoisting system according to claim 1, wherein for each hoisting device said intermediate, unidirectional clutch disk is sandwiched between a hub fixed to said shaft providing a connection between said drum and said central shaft and a nut-plate, and said hub includes a first thrust surface perpendicular to said shaft against which said intermediate clutch disk bears, said nut-plate is mounted on a threaded bearing surface of said central shaft and includes a second thrust surface against which an opposite side of said intermediate clutch disk bears, a centralizer including drive fingers which penetrate into recesses of said toothed disk for rotating said nut-plate, and thereby shifting said nut-plate slightly axially relative to said centralizer for effecting rotation of said toothed disk in a direction corresponding to that of raising said load caused by said nut-plate moving axially in a direction pressing said nut-plate against said intermediate unidirectional clutch disk of said hoisting device.

3. A load-hoisting system according to claim 1, further comprising two return sheaves, and wherein said cable of each said hoisting device attached to the load passes over a respective return sheave prior to being wound onto a respective winch drum, said fixed frame mounts said two return sheaves at respective ends of a spreader bar horizontally hinged at a middle of the spreader bar to a member fixed to said fixed frame, vertically above said load, and wherein said system further comprises two abutments mounted to said fixed frame proximate to said spreader bar to opposite sides of a hinge axis of said spreader bar for limiting tilting of said spreader bar from the horizontal, and detectors mounted to said fixed frame proximate to said spreader bar for detecting the approach of the spreader bar ends to respective abutments.

4. A load-hoisting system according to claim 1, wherein said fixed frame comprises a vertical column, and said system further comprises means for slidably mounting said load on said vertical column for movement of said load vertically on said column.

* * * * *